United States Patent [19]

Ross

[11] Patent Number: 4,575,892

[45] Date of Patent: Mar. 18, 1986

[54] DEVICE FOR CLEANING ELECTRICAL CONNECTORS

[75] Inventor: Gerald W. Ross, Tulare, Calif.

[73] Assignee: Norman R. Ross, Tulare, Calif. ; a part interest

[21] Appl. No.: 656,549

[22] Filed: Oct. 1, 1984

[51] Int. Cl.[4] ..... A46B 3/18; A46B 7/00

[52] U.S. Cl. ..... 15/106; 15/104.04; 15/104.2; 15/160

[58] Field of Search ..... 15/106, 160, 104.2, 15/104.04, 206

[56] References Cited

U.S. PATENT DOCUMENTS

| | | | |
|---|---|---|---|
| 606,184 | 6/1898 | Burnip | 15/160 |
| 1,710,127 | 4/1929 | Vaughn . | |
| 1,950,862 | 3/1934 | Page | 15/106 |
| 3,076,988 | 2/1963 | Mills | 15/104.04 |
| 3,088,150 | 5/1963 | Sweeney . | |
| 3,629,895 | 12/1971 | Colgan | 15/160 |
| 4,014,063 | 3/1977 | Bunke | 15/111 |
| 4,133,070 | 1/1979 | Litt | 15/106 |
| 4,195,381 | 4/1980 | Jurich, III | 15/104.2 |
| 4,204,294 | 5/1980 | Halverson | 15/185 |
| 4,301,567 | 11/1981 | Tucker | 15/160 |
| 4,372,003 | 2/1983 | Toelke | 15/104.04 X |

*Primary Examiner*—Timothy F. Simone

*Attorney, Agent, or Firm*—Worrel & Worrel

[57] ABSTRACT

A device for cleaning male and female electrical connectors, the device providing a body having spaced, opposite ends one of which is adapted for use in cleaning a female electrical connector and the other of which is adapted for use in cleaning a male electrical connector, the body further having guide means on each end for aligning the end with the connector for which it is adapted to clean.

6 Claims, 9 Drawing Figures

DEVICE FOR CLEANING ELECTRICAL CONNECTORS

BACKGROUND OF THE INVENTION

1. Field of the Invention.

The present invention relates to a device for cleaning electrical connectors and more particularly to such a device which is adapted for use in cleaning male and female electrical connectors installed on vehicles such as tractor-trailers and the like.

2. Description of the Prior Art.

It has long been known to provide detachable, electrical terminal connectors on tractor-trailers, semi-trailers, trucks and like vehicles, for connecting a source of electrical energy carried on one portion of the vehicle with electrically-operated lights, apparatuses and the like borne on a portion of the vehicle remote from the source of electrical energy. Typically, such terminals or connectors are embodied in the form of a predetermined male portion and a separate, predetermined female portion adapted to be disengageably mated to provide an electrically-conductive connection between the source of the electrical energy and the location to which it is desired to deliver electrical energy.

In particular, it has become well known to provide tractor-trailers or semi-trailers with such electrical connectors or terminals, one of which is mounted on the tractor portion of the vehicle and the other of which is carried on the trailer portion of the vehicle. Typically, the male connector provides a plurality of elongated, rod-like terminal members constructed of an electrically-conductive material and disposed in predetermined spaced relation to each other. In some embodiments, the male portion provides a base portion from which the rod-like members extend in substantially rigid, axially erect relation spaced a predetermined distance from each other. The rod-like members are connected through the base to the electrical conductors of the electrical system as by wires or the like.

The female connector typically provides a substantially solid body having a plurality of bores extending into it and accessible through corresponding external openings. The bores are disposed in spaced relation corresponding substantially to that of the rod-like members of the male connector and are dimensioned for close-fitting, removable insertion of the rod-like members into them. The bores of many such female connectors provide internal sleeves of electrically-conductive material, such as copper, brass, or the like, or are in other ways lined with electrically-conductive material whereby, upon mating of the male and female connectors, the rod-like members are disposed in electrically-conductive relation with discrete portions of the female connector for the selective flow of electrical energy through individual female connectors and rod-like members, whereby selected individual lighting systems, for instance, can be actuated without the flow of electricity to other electrical systems carried on the trailer or other portion of the vehicle.

In some commercial embodiments, the male connector provides a protective housing having a substantially cylindrical internal wall collectively surrounding the rod-like members and defining a substantially circular external opening dimensioned to permit insertion of the female connector therein. A slot or channel is typically defined in one portion of the cylindrical wall extending partly or completely from the external opening toward the base. The female connector is dimensioned for substantially close-fitting insertion within the housing and provides an elongated, embossed portion or ridge corresponding in length and dimensions to that of the slot or channel in the male connector housing. The ridge is disposed in predetermined relation to the bores to permit alignment of the female connector and the bores with the male connector and the rod-like members to assure proper connection of the female and male connectors.

Many male connectors provide a spring-loaded, hinged door or cover adapted to be tensively retained in substantially sealing relation to the external opening of the housing, ostensibly to prevent the entry of dirt, moisture and the like into the housing when the electrical connectors are disengaged.

However, it is well known that debris, such as dirt, grease, road salt, moisture and the like, tends to accumulate within the housing of the male connector and the bores of the female connector, causing a consequent fouling of the general connector environment. Such fouling interferes with the effective operation of the connectors and often prevents the establishment of a reliable electrical connection between the male and female connectors when they are mated, with the possible resultant failure of one or more of the electrical systems carried by the trailing vehicle. Such debris can also result in corrosion of the electrically-conductive portions of the connectors, necessitating replacement of one or both connectors, or it can lead to a "shorting out" of a portion of the vehicle's electrical system. Thus, periodic cleaning of the bores of the female connector and the housing and rod-like members of the male connector is necessary.

It has been known to employ abrasive cleaning devices, such as sandpaper, files and elongated brushes having peripherally disposed bristles, in attempting to remove accumulated debris from male and female connectors. While many of such devices are generally effective for removing some of the accumulated contaminants, they have long been known to be generally unacceptable due to the amount of time and effort required to achieve a relatively thorough cleaning operation on both connectors. Also, many of such devices are of insubstantial construction and require frequent replacement. Moreover, it is well known that the use of devices constructed in whole or in part of metal or other material having electrically-conductive properties can pose a potential hazard for the user thereof if such cleaning device is brought into engagement with an electrically-charged portion of an electrical connector.

Therefore, it has long been known that it would be desirable to have a device adapted for cleaning electrical connectors, and more particularly that it would be desirable to have such a device which is adapted for the cleaning of male and female connectors in an electrical system such as that typically employed on tractor-trailers or semi-trailers and which can be employed rapidly and relatively effortlessly to effect a thorough cleaning of the connectors.

OBJECTS AND SUMMARY OF THE INVENTION

Therefore, it is an object of the present invention to provide a device for cleaning electrical connectors.

Another object is to provide such a device which is particularly adapted for cleaning male and female electrical connectors of the type commonly employed on tractor-trailers, semi-trailers and like vehicles.

Another object is to provide such a device which is of compact and sturdy design.

Another object is to provide such a device which is characterized by ease of operation and which is adapted to clean such electrical connectors in a minimum amount of time.

Another object is to provide such a device which is adapted to be used under even the most adverse conditions or in situations in which visual inspection of the electrical connectors to be cleaned is hampered by limited availability of illumination.

Another object is to provide such a device which can be manufactured economically and sold at a nominal price.

Further objects and advantages are to provide improved elements and arrangements thereof in a device for the purposes described which is dependable, economical, durable and fully effective in accomplishing its intended purposes.

DESCRIPTION OF THE PREFERRED EMBODIMENT

Figure 1:
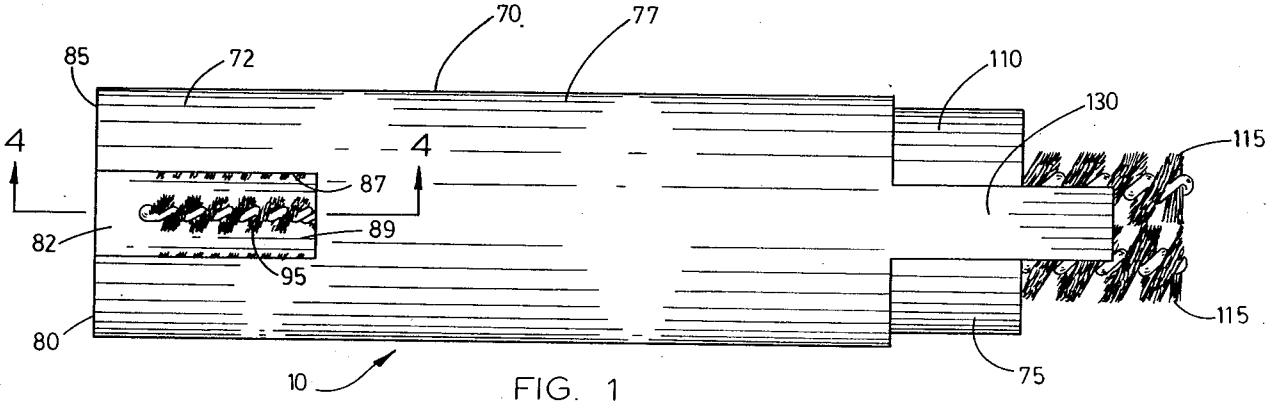
FIG. 1 is a top plan view of the device embodying the principles of the present invention.

Referring more particularly to the drawings, the device embodying the principles of the present invention is designated generally by the numeral 10 in FIG. 1.

The device 10 is adapted for use in a typical operative environment illustrated in FIGS. 6, 7, 8 and 9. As shown in those figures, the typical operative environment generally comprises a predetermined female electrical connector 13 and a predetermined male electrical connector 15 individually adapted to be mounted on a portion of a vehicle.

The female electrical connector provides a substantially rigid body 20 having a generally cylindrical configuration. The body 20 of the female electrical connector 13 provides an elongated ridge or boss 23 extending longitudinally along the periphery or exterior surface 25 thereof. The female connector 13 provides a plurality of elongated bores 28 extending into the body 20 thereof a predetermined distance and each having a predetermined internal diameter. The bores are disposed in a predetermined relationship or pattern and are aligned in substantially axially parallel relation to each other. As can best be seen in FIG. 6, the female connector typically provides seven bores, six of which are of substantially identical dimensions, the seventh bore 30 having a diameter greater that that of the other six bores. It is recognized, however, that some conventional female connectors may provide greater or less than seven bores. The seventh bore 30 is disposed in close proximity to the boss 23. Each bore provides an internal terminal or surface 33 constructed of or bearing an electrically-conductive material leading to an externally-communicating wire 35 or other electrical conductor.

Figure 7:
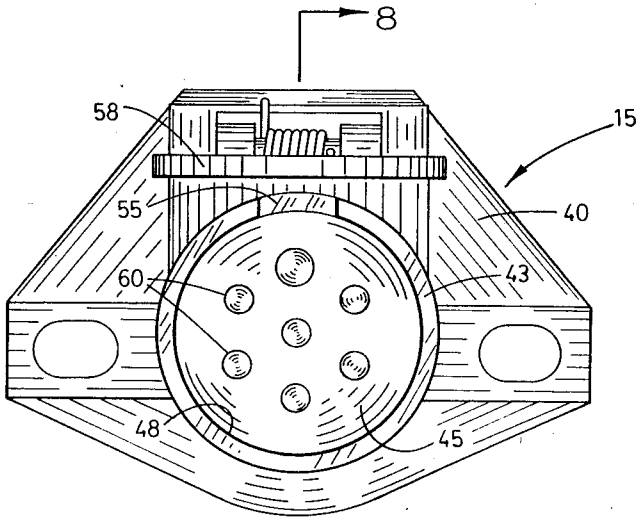
FIG. 7 is an end elevational view of a representative male electrical connector adapted detachably to be mated with a female connector constructed substantially similarly to that of FIG. 6.
Figure 8:
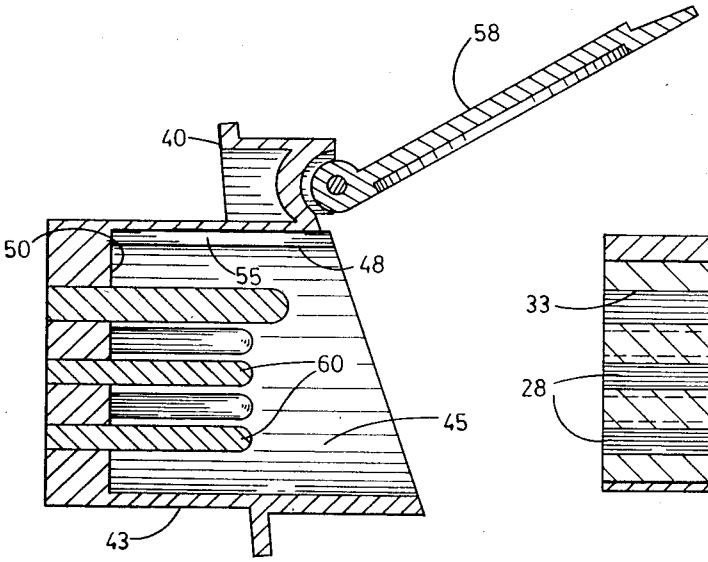
FIG. 8 is a longitudinal section taken on line 8—8 in FIG. 7.

The female connector 13 is dimensioned and configured to be mated in electrically-conductive relation with a typical male electrical connector 15, illustrated in FIGS. 7 and 8. As shown therein, the male connector 15 is substantially similar to such a connector as might typically be deployed on a conventional semi-trailer or tractor-trailer.

The male connector provides a frame 40 mounting a substantially cylindrical, hollow housing 43 disposed substantially transversely to the frame. The housing 43 defines an internal chamber 45 having a substantially cylindrical internal wall 48 terminating internally in a substantially flat base portion 50. The internal wall 48 provides a recess or slot 55 extending rearwardly within the housing toward the base. The slot is configured and dimensioned for substantially close-fitting alignment of the boss 23 of the female connector 13 therewith. A hinged, spring-biased cover 58 is mounted on the housing 43 and is adapted to be disposed by spring tension in covering relation to the chamber. As shown in FIG. 7, the cover 58 is disposed in an opened attitude for purposes of illustration.

Projecting forwardly from the base 50 of the internal wall 48 of the housing 43 is a plurality of rod-like members or terminals 60 a predetermined relationship or pattern. As shown in FIG. 7, the typical male connector 15 illustrated therein provides seven terminals disposed in substantially axially parallel relation to each other and spaced for substantially simultaneous insertion thereof into corresponding bores 28 in the female connector 13 when the female connector and male connector are mated. The male connector terminals 60 are dimensioned for substantially close-fitting insertion within their corresponding bores and, accordingly, six of the terminals are of substantially equivalent dimensions and the seventh terminal 65 is dimensioned for insertion within the seventh bore 30 of the female connector. The male terminals are constructed of an electrically-conductive material and are typically connected in electrically-conductive relation to wires or the like leading from the electrical connector to remote portions of the electrical system of the vehicle.

As can best be seen in FIG. 1, the device 10 of the present invention generally provides a body 70 having a first or female cleaning portion 72 and an opposite, second, or male cleaning portion 75 mounted on opposite ends of an elongated, intermediate section 77.

The female cleaning portion 72 provides a substantially continuous, incompletely cylindrical wall 80 bounding a chamber or cavity 82. The wall has an endmost edge 85 of substantially circular configuration defining an opening communicating with the cavity. The wall further provides a second edge 87 bounding a laterally communicating opening or slot 89 of predetermined dimensions. The slot 89 is configured and dimensioned for a substantially close-fitting, slidably removable insertion of portions of the boss 23 of the female connector 13 therein.

Figure 2:
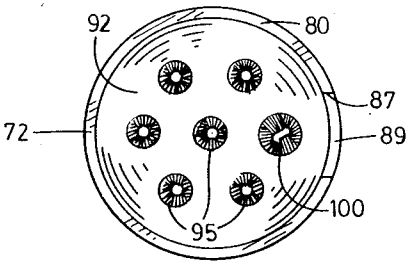
FIG. 2 is an end view of the device of FIG. 1.
Figure 4:
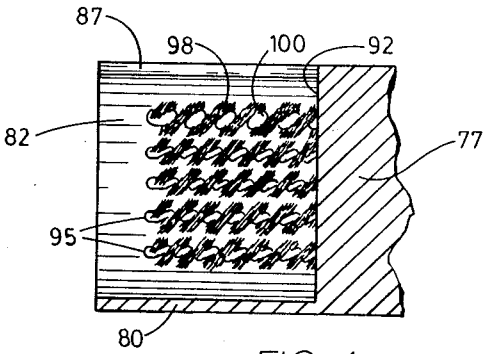
FIG. 4 is a sectional view taken on line 4—4 in FIG. 1.

The female cleaning portion has a base wall 92 which is preferably, although not necessarily, substantially flat and disposed substantially transversely to the longitudinal axis of the body 70 of the device 10. A plurality of cleaning members, abrasion members or brushes 95 are mounted by the base wall 92 and extend therefrom in substantially axially erect disposition. The number of brushes is equal to the number of bores provided in the female electrical connector for the cleaning of which the device is adapted. The brushes are disposed in predetermined spaced relationship or pattern to each other. The brushes are elongated and are acceptably of substantially conventional construction providing an elongated, substantially straight central core constructed of rigid wire or other suitable material and providing a multiplicity of radially-extended, limitedly flexible bristles defining a substantially helical abrasion surface 98. As can best be seen upon reference to FIG. 2, the brushes are substantially circular when viewed on end and, accordingly, individually have a predetermined diameter. The brushes are disposed in predetermined spaced relation to space the longitudinal axes thereof in substantially the same spacial relation as that of the bores 30 of the female connector 13. The diameter of each brush is somewhat greater than that of the bores of the female connector, with one of the brushes 100 having a greater diameter than the remaining brushes. Such brush is adapted for use in cleaning the seventh bore 30 of the female connector. Preferably, the bristles of the brushes are constructed of a material having limited flexibility, such as wire or the like, to permit the insertion thereof into a bore having a lesser diameter than the individual brush and to provide a maximal abrasive effect upon reciprocal movement of the brush within the bore. The brush having the largest diameter is disposed in closest proximity to the slot 89 whereby, upon alignment of the slot with the boss 23 of the female connector, the largest of the brushes can be easily aligned with the largest of the bores.

Figure 3:
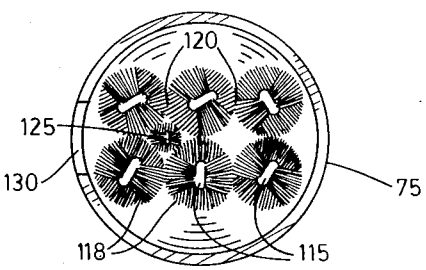
FIG. 3 is a view of the end of the device of FIG. 1 opposite that shown in FIG. 2.
Figure 5:
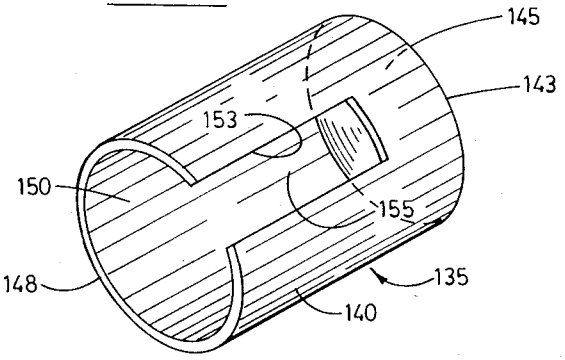
FIG. 5 is a perspective view of a cap adapted for attachment on the end of the device shown in FIG. 3.

The male cleaning portion 75 provides a substantially cylindrical brush mounting portion or plug 110 extending longitudinally from the intermediate portion 77 of the body 70. A plurality of cleaning members, abrasion members or brushes 115 are mounted by the plug 110 and are constructed preferably substantially in the manner of the brushes 95 of the female cleaning portion. In the embodiment illustrated, and as can best be seen by reference to FIG. 3, the male cleaning portion provides seven brushes. Six of the brushes are of substantially identical diameter and are disposed in two substantially parallel rows of three brushes apiece. The brushes each provide a periphery 118 of substantially circular configuration when viewed on end in the manner of FIG. 3. The peripheries 118 of adjacent brushes are preferably disposed substantially tangentially to define an interface area or region 120 at the point or points of contact between the peripheries 118 of the brushes. A seventh brush 125 having a diameter substantially less than that of the remaining six brushes, is disposed in a substantially axially erect attitude surrounded by four brushes, as can best be seen in FIG. 3. The seventh brush 125 is dimensioned and positioned to permit the bristles thereof to contact portions of the periphery of each of the four brushes.

The male cleaning portion 75 further provides a projecting tongue or guide member 130 extending from the intermediate portion 77. The guide member is disposed adjacent the plug 110 and is dimensioned and configured for substantially close-fitting slidable insertion thereof within the slot 55 in the housing 43 of the male connector 15. As can best be seen by reference to FIG. 3, the guide member is disposed substantially diametrically remotely from those brushes 115 which are not contacted by the seventh brush 125.

A protective cap 135 is provided and is adapted for removable deployment on the male cleaning portion 75 when the device 10 is not in use. The cap generally provides a substantially cylindrical wall 140 having a first end 143 sealed by an end panel 145 and a second end 148 defining a substantially circular opening 150. An edge 153 extends from the second end 148 and defines a slot 155 dimensioned substantially closely to receive the guide member 130 of the male cleaning portion 75 when the cap is disposed thereon. The cylindrical wall 140 of the cap 135 is dimensioned substantially closely to receive the plug 110 therein when the cap is disposed in covering relation on the male cleaning portion.

OPERATION

The operation of the described embodiment is believed readily apparent and is briefly summarized at this point.

Figure 6:
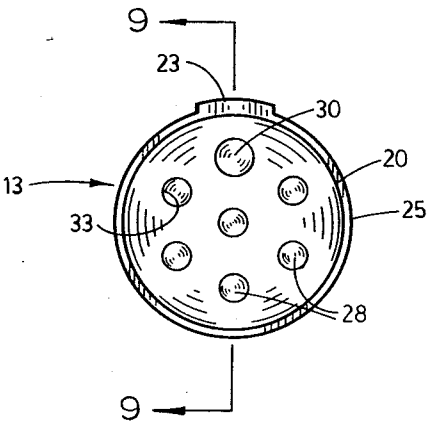
FIG. 6 is an end elevational view of a female electrical connector representative of the type adapted to be cleaned by operation of the device of FIG. 1.
Figure 9:
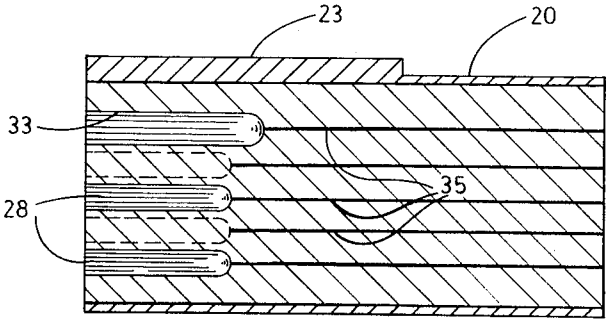
FIG. 9 is a longitudinal sectional view taken on line 9—9 in FIG. 6.

For cleaning a female electrical connector 13 constructed in the manner of that illustrated in FIGS. 6 and 9, the device 10 is grasped along the intermediate portion 77 and the slot 89 of the female cleaning portion 72 is aligned with the boss 23 of the female electrical connector. The brushes 95 are accordingly aligned with the bores 28 of the female connector and the device is then moved axially toward the female connector to substantially simultaneously insert the brushes into the bores and to receive the boss 23 within the slot. The device 10 is then reciprocated axially back and forth to effect an abrasive cleaning action of the internal surface 33 of each bore 28 simultaneously with the others, with the operation being repeated as needed to effect a thorough removal of debris from the bores.

For cleaning a male electrical connector, such as that illustrated in FIGS. 7 and 8, the cap 135 is first removed from the male cleaning portion 75. The cover 58 of the male electrical connector is lifted away from the housing 43 to expose the rod-like terminals 60 within the chamber 45 of the housing. The guide member 130 of the male cleaning portion of the device is aligned with the slot 55 in the internal wall 48 of the housing of the male electrical connector. The device is then moved axially toward and into the housing and the guide member is inserted within the slot. As the male cleaning portion is inserted further into the housing, the rod-like terminals will each be simultaneously circumscribed substantially completely and engaged by a pair of the brushes 115 along the interface regions 120 defined by the brushes. Slight deformation of the bristles of each brush upon engagement of the rod-like terminals permits the substantially complete surrounding of the rod-like members, whereby reciprocal axial movement of the device will effect an abrasive cleaning action over substantially the entire surface of each rod-like terminal. It will be seen that it is not necessary for the operator of the device 10 to hold the cover 58 of the male electrical connector in an opened attitude while the cleaning operation is taking place because the guide member 130 and intermediate portion 77 will provide a substantially continuous, smooth surface against which the cover can rest during the cleaning of the male electrical connector. It will also be seen that both the slot 89 of the female cleaning portion and the guide member 130 of the male cleaning portion serve as effective alignment references during the cleaning of the connectors, permitting the safe and effective use of the device under even the most adverse conditions and particularly in those situations in which visibility is limited and would prevent effective alignment of the brushes with their corresponding bores or rod-like members, respectively.

Also, it will be seen that the device 10 of the present invention virtually guarantees that none of the bores 28 or rod-like terminals 60 of the respective electrical connectors will be inadvertently omitted from the cleaning operation, inasmuch as each one is cleaned simultaneously with the others. Thus, particularly with regard to the bores of the female connector, where visual inspection might be inadequate to determine whether a bore has been cleaned, such inspection is virtually unnecessary when using the device of the present invention.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A device for cleaning electrical connectors of the type having a female connector and a male connector dimensioned releasably to be disposed in mating relation and wherein the female connector has a body mounting an external elongated boss and having a plurality of elongated bores extending therewithin in substantially parallel relation in a predetermined pattern and wherein the male connector has a housing bounding a chamber dimensioned to receive a portion of the body of the female connector and having a slot dimensioned to receive said boss of the body of the female connector, and a plurality of rod-like terminals spaced from each other within the housing of the male connector in a pattern substantially conforming to said predetermined pattern of the bores of the body of the female connector and each terrminal is dimensioned for individual receipt within one of said bores when the body of the female connector is received within said chamber of the male connector, and said housing mounting a cover pivotal between a closed attitude wherein the cover is disposed in covering relation to said chamber and an opened attitude wherein the cover is pivoted from the chamber, the device comprising:

an elongated intermediate portion having spaced, opposite ends;

a female cleaning portion borne on a first opposite end of the intermediate portion and having a substantially cylindrical wall bounding a cavity dimensioned to receive a portion of the body of a female connector therein, said wall having a slot dimensioned to receive said boss of the body of the female connector when said portion of the body is received within said cavity, and a plurality of elongated brushes mounted within said cavity in a pattern substantially conforming to said predetermined pattern of the bores of the body of the female connector for substantially simultaneous individual receipt in a plurality of the bores of the body of the female connector when said body is received within the cavity for abrasively cleaning said bores upon reciprocal movement of the device during said receipt; and a male cleaning portion borne on a second opposite end of the intermediate portion and having a plurality of elongated brushes each being disposed in juxtaposition to at least one other of said brushes to define an interface area and said interface areas disposed in a pattern substantially conforming to said pattern of the rod-like terminals for engagement of the brushes defining the interface areas with the rod-like terminals for abrasively cleaning said rod-like terminals upon reciprocal movement of the device during said engagement.

2. The device of claim 1 wherein the male cleaning portion mounts a guide member dimensioned for receipt within the slot of the housing of the male connector.

3. The device of claim 2 wherein the number of brushes of the female cleaning portion is the same as the number of bores of the body of the female connector.

4. The device of claim 3 wherein the intermediate portion is dimensioned to retain said cover of a male connector in the opened attitude when the male cleaning portion is received within the housing of the male connector.

5. The device of claim 4 wherein a protective cap is dimensioned for removable mounting on the male cleaning portion to encase the brushes.

6. A device for cleaning electrical connectors adapted to be disposed in mating relation to establish paths of electrical conductivity therethrough and consisting of a female connector having a plurality of bores extending therewithin along substantially parallel paths and arranged in a predetermined pattern and a male connector having a plurality of rod-like terminals extending along substantially parallel paths and arranged in a predetermined pattern and having dimensions permitting individual slidable receipt within the bores of the female connector releasably to establish said mating relationship, the rod-like terminals enclosed in a housing slidably received about the female connector in said mating relationship, the device comprising a body having a first end portion and an opposite second end portion dimensioned for slidable receipt within said housing of the male connector; a plurality of first abrasion members mounted on the first end portion in substantially parallel relation in a pattern substantially conforming to said pattern of the bores of the female connector; and a plurality of second abrasion members mounted on the second end portion of the body in substantially parallel relation in a pattern such that each second abrasion member is disposed in juxtaposition to at least one other second abrasion member to define an interface area and said interface areas disposed in a pattern substantially conforming to said pattern of the rod-like terminals whereby said second abrasion members can be placed in mating relation with the rod-like terminals of the male connector and, alternatively, the first abrasion members can be placed in mating relation with the bores of the female connector and in both said mating relationships said connectors cleaned by reciprocation of the body while maintaining the mating relationship.

* * * * *